US010431140B2

(12) United States Patent
Heo et al.

(10) Patent No.: US 10,431,140 B2
(45) Date of Patent: Oct. 1, 2019

(54) DISPLAY DEVICE CONTROLLING SCAN VOLTAGE LEVEL ACCORDING TO AMBIENT TEMPERATURE AND OPERATING METHOD THEREOF

(71) Applicant: SAMSUNG DISPLAY CO., LTD., Yongin, Gyeonggi-do (KR)

(72) Inventors: Se Young Heo, Yongin-si (KR); Jong Jae Lee, Yongin-si (KR); Seok Hwan Lee, Yongin-si (KR); Jun Ki Hong, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 463 days.

(21) Appl. No.: 15/133,797

(22) Filed: Apr. 20, 2016

(65) Prior Publication Data

US 2017/0098409 A1 Apr. 6, 2017

(30) Foreign Application Priority Data

Oct. 1, 2015 (KR) ..... 10-2015-0138739

(51) Int. Cl.
*G09G 5/00* (2006.01)
*G09G 3/20* (2006.01)
(Continued)

(52) U.S. Cl.
CPC ..... *G09G 3/2092* (2013.01); *G09G 3/3266* (2013.01); *G09G 3/3677* (2013.01);
(Continued)

(58) Field of Classification Search
CPC .. G09G 3/3674; G09G 3/2092; G09G 3/3266; G09G 3/3677; G09G 3/3696
(Continued)

(56) References Cited

U.S. PATENT DOCUMENTS 8,766,708 B2 7/2014 Lee
2005/0231496 A1* 10/2005 Kim ..... G09G 3/3696 345/204
(Continued)

FOREIGN PATENT DOCUMENTS

KR 10-2006-0110692 * 10/2006 ..... G02F 1/133
KR 1020070075828 A 7/2007
(Continued)

OTHER PUBLICATIONS

Extended European Search Report for Application No. 16176138.2 dated Feb. 2, 2017.

*Primary Examiner* — Adam J Snyder
(74) *Attorney, Agent, or Firm* — Cantor Colburn LLP

(57) ABSTRACT

A display device includes a display unit including pixels coupled to scan lines and data lines, a data driver which supplies a data signal to pixels through the data lines, a scan driver which generates a scan signal using a first scan voltage and a second scan voltage, and supplying the scan signal to the pixels through the scan lines, a processor which generates first scan voltage information by setting a first scan voltage level, based on an ambient temperature of the display device, a timing controller which generates a power control signal using the first scan voltage information and delta voltage information, and a power supply which generates the first scan voltage and a delta voltage using the power control signal, and generates the second scan voltage by dropping the delta voltage from the first scan voltage.

17 Claims, 4 Drawing Sheets

(51) Int. Cl.
*G09G 3/3266* (2016.01)
*G09G 3/36* (2006.01)

(52) U.S. Cl.
CPC ... *G09G 3/3696* (2013.01); *G09G 2300/0426* (2013.01); *G09G 2310/0202* (2013.01); *G09G 2310/027* (2013.01); *G09G 2310/0267* (2013.01); *G09G 2310/0289* (2013.01); *G09G 2310/08* (2013.01); *G09G 2320/041* (2013.01); *G09G 2330/00* (2013.01); *G09G 2330/02* (2013.01); *G09G 2330/028* (2013.01)

(58) Field of Classification Search
USPC ..... 345/211
See application file for complete search history.

(56) References Cited

U.S. PATENT DOCUMENTS

2007/0024554 A1* 2/2007 Ko ..... G09G 3/3696 345/87
2007/0035501 A1* 2/2007 Moh ..... G09G 3/3696 345/98
2007/0040825 A1* 2/2007 Mamba ..... G09G 3/3614 345/211
2007/0052646 A1* 3/2007 Ishiguchi ..... G09G 3/3648 345/92
2009/0102779 A1* 4/2009 Jo ..... G09G 3/3696 345/101
2009/0278832 A1* 11/2009 Cho ..... G09G 3/3648 345/211
2010/0039364 A1* 2/2010 Lee ..... G09G 3/3696 345/100
2010/0053054 A1* 3/2010 Jeong ..... G09G 3/3674 345/92
2011/0205212 A1* 8/2011 Matsumoto ..... G09G 3/3677 345/211
2012/0169744 A1* 7/2012 Seo ..... G09G 3/3696 345/519
2014/0111499 A1* 4/2014 Jang ..... G09G 3/3696 345/212
2014/0168041 A1* 6/2014 Chen ..... G09G 3/3696 345/87
2014/0307193 A1 10/2014 Park et al.
2015/0115826 A1 4/2015 Koo et al.

FOREIGN PATENT DOCUMENTS

KR 1020130064370 A 6/2013
WO 2005073951 A1 8/2005

* cited by examiner

| | L_VSS1 | L_VSS2 | ⊿V |
|---|---|---|---|
| T<20°C | -4V | -8V | 4V |
| 20°C≦T<40°C | -5V | -9V | 4V |
| 40°C≦T | -6V | -10V | 4V |
| ⋮ | ⋮ | ⋮ | ⋮ |

LUT

DISPLAY DEVICE CONTROLLING SCAN VOLTAGE LEVEL ACCORDING TO AMBIENT TEMPERATURE AND OPERATING METHOD THEREOF

This application claims priority to Korean Patent Application No. 10-2015-0138739, filed on Oct. 1, 2015, and all the benefits accruing therefrom under 35 U.S.C. § 119, the entire content of which in its entirety is herein incorporated by reference.

BACKGROUND

1. Field

Exemplary embodiments of the invention relate to a display device and an operating method thereof.

2. Description of the Related Art

Recently, various types of display devices including an organic light emitting display device, a liquid crystal display device, a plasma display device, and the like, have been widely used.

Each of these display devices generally includes a display unit including pixels for displaying images, a timing controller for generating control signals to be supplied to the pixels, a data driver for supplying data signals to the pixels, a scan driver for supplying scan signals to the pixels, and a power supply for generating power to drive the display device.

The scan driver includes a scan driving circuit supplied with a high-level scan voltage and a low-level scan voltage to generate a scan signal.

SUMMARY

When a scan driving circuit is operated at a high temperature, a leakage current may be generated. Also, a threshold voltage of pixels is lowered at the high temperature. Therefore, when the pixels receive a scan signal including noise, a data signal is applied to the pixels at an unintended time.

In order to solve this problem, there may be proposed a method of lowering the high-level scan voltage when ambient temperature is high. According to the method, it is possible to secure a margin in an operation of turning off a switching transistor included in each pixel.

Exemplary embodiments provide a display device and an operating method thereof, which can control the level of a scan voltage according to temperature and constantly maintain a difference between a high-level scan voltage and a low-level scan voltage.

According to an exemplary embodiment of the invention, there is provided a display device including a display unit which includes pixels coupled to scan lines and data lines, a data driver which supplies a data signal to pixels through the data lines, a scan driver which generates a scan signal using a first scan voltage and a second scan voltage, and supply the scan signal to the pixels through the scan lines, a processor which generates first scan voltage information by setting a first scan voltage level, based on an ambient temperature of the display device, a timing controller which generates a power control signal using the first scan voltage information and delta voltage information, and a power supply which generates the first scan voltage and a delta voltage using the power control signal, and generates the second scan voltage by dropping the delta voltage from the first scan voltage.

In an exemplary embodiment, the processor may set the first scan voltage level to be a first voltage level when the ambient temperature is higher than or equal to a reference temperature, and set the first scan voltage level to be a second voltage level when the ambient temperature is lower than the reference temperature.

In an exemplary embodiment, the first voltage level may be lower than the second voltage level.

In an exemplary embodiment, the processor may set the first scan voltage level to be in inverse proportion to a change in the ambient temperature.

In an exemplary embodiment, the timing controller may generate the delta voltage information by setting the delta voltage to be a constant level regardless of the ambient temperature.

In an exemplary embodiment, the timing controller may generate the delta voltage information by determining a level difference between the first scan voltage and the second scan voltage.

In an exemplary embodiment, the power supply may include a digital-analog converter which generates the first scan voltage, based on the first scan voltage information, and generates the delta voltage, based on the delta voltage information, and a scan voltage generator which generates the second scan voltage by dropping the delta voltage from the first scan voltage, and supplies the first scan voltage and the second scan voltage to the scan driver.

In an exemplary embodiment, the power supply may further include a scan voltage comparator to which the first scan voltage and the second scan voltage supplied to the scan driver are fed back, which compares the fed-back first and second scan voltages with reference voltages, respectively, and which supplies a comparison result to the scan voltage generator.

In an exemplary embodiment, the scan voltage generator may generate a first scan voltage and a second scan voltage, which are respectively corrected by boosting or dropping the first and second scan voltages, based on the comparison result.

In an exemplary embodiment, the corrected first scan voltage and the corrected second scan voltage may have the difference of the delta voltage.

In an exemplary embodiment, the scan driver may generate the scan signal having the first scan voltage level and a second scan voltage level.

In an exemplary embodiment, when the supplied scan signal has the first scan voltage level, each of the pixels may be supplied with the data signal.

In an exemplary embodiment, the display device may further include a memory which stores a look-up table including the first scan voltage level corresponding to the ambient temperature.

According to an exemplary embodiment of the invention, there is provided a method of operating a display device including a scan driver for generating a scan signal using a first scan voltage and a second scan voltage, the method including setting, by a processor, a first scan voltage level of the first scan voltage, based on an ambient temperature of the display device, setting, by a timing controller, a delta voltage level by determining a difference between the first scan voltage and the second scan voltage, generating, by a power supply, the first scan voltage corresponding to the first scan voltage level, generating, by the power supply, a delta voltage corresponding to the delta voltage level, generating, by the power supply, the second scan voltage by reflecting the delta voltage to the first scan voltage, and supplying, by the power supply, the first scan voltage and the second scan voltage to the scan driver.

In an exemplary embodiment, in the setting the first scan voltage level, the first scan voltage level may be set to be a first voltage level when the ambient temperature is higher than or equal to a reference temperature, and the first scan voltage level may be set to be a second voltage level when the ambient temperature is lower than the reference temperature.

In an exemplary embodiment, in the generating the second scan voltage, the second scan voltage may be generated by dropping the delta voltage level from the first scan voltage level.

In an exemplary embodiment, the method may further include feeding back the first scan voltage and the second scan voltage, which are supplied to the scan driver, to the power supply, comparing, by the power supply, the fed-back first and second scan voltages with reference voltages, and adjusting, by the power supply, the first scan voltage and the second scan voltage using a comparison result.

In the display device and the operating method thereof according to the invention, the first scan voltage level and the second scan voltage level are controlled corresponding to an ambient temperature, so that it is possible to prevent noise from being generated in the generation of scan signals and block the generation of leakage current, thereby minimizing current consumption of the scan driver.

Also, the first scan voltage and the second scan voltage can be monitored in real time, thereby stably generating the first scan voltage and the second scan voltage.

BRIEF DESCRIPTION OF THE DRAWINGS

Exemplary embodiments will now be described more fully hereinafter with reference to the accompanying drawings, in which.

DETAILED DESCRIPTION

Figure 1:
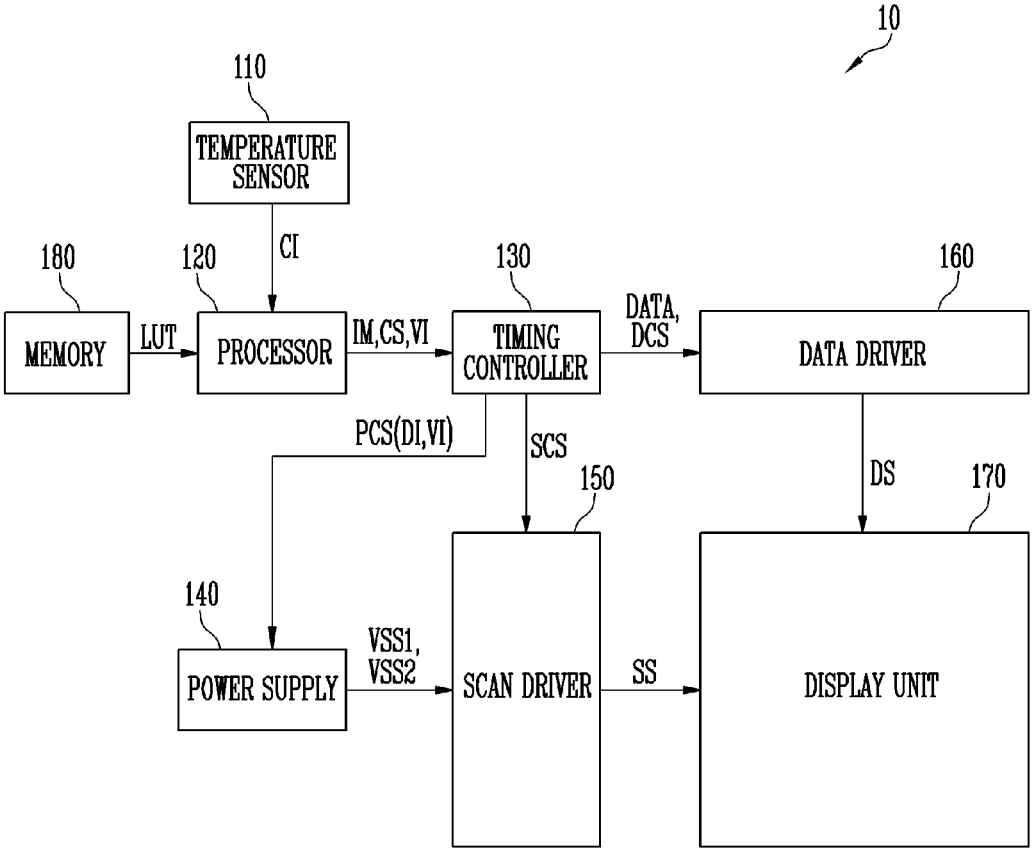
FIG. 1 is a schematic block diagram illustrating an exemplary embodiment of a display device according to the invention.

The specific structural or functional description disclosed herein is merely illustrative for the purpose of describing exemplary embodiments according to the concept of the invention. The exemplary embodiments according to the concept of the invention can be implemented in various forms, and can not be construed as limited to the exemplary embodiments set forth herein.

The exemplary embodiments according to the concept of the invention can be variously modified and have various shapes. Thus, the exemplary embodiments are illustrated in the drawings and are intended to be described herein in detail. However, the exemplary embodiments according to the concept of the invention are not construed as limited to specified inventions, and include all changes, equivalents, or substitutes that do not depart from the spirit and technical scope of the invention.

While terms such as "first" and "second" may be used to describe various components, such components must not be understood as being limited to the above terms. The above terms are used only to distinguish one component from another. For example, a first component may be referred to as a second component without departing from the scope of rights of the invention, and likewise a second component may be referred to as a first component.

It will be understood that when an element is referred to as being "connected to" another element, it can be directly connected to the other element or intervening elements may also be present. In contrast, when an element is referred to as being "directly connected to" another element, no intervening elements are present. Meanwhile, other expressions describing relationships between components such as "~ between," "immediately ~ between" or "adjacent to ~" and "directly adjacent to ~" may be construed similarly.

The terms used in the application are merely used to describe particular exemplary embodiments, and are not intended to limit the invention. Singular forms in the invention are intended to include the plural forms as well, unless the context clearly indicates otherwise. It will be further understood that terms such as "including" or "having," etc., are intended to indicate the existence of the features, numbers, operations, actions, components, parts, or combinations thereof disclosed in the specification, and are not intended to preclude the possibility that one or more other features, numbers, operations, actions, components, parts, or combinations thereof may exist or may be added.

It will be understood that when an element is referred to as being "on" another element, it can be directly on the other element or intervening elements may be therebetween. In contrast, when an element is referred to as being "directly on" another element, there are no intervening elements present.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

So far as not being differently defined, all terms used herein including technical or scientific terminologies have meanings that they are commonly understood by those skilled in the art to which the invention pertains. The terms having the definitions as defined in the dictionary should be understood such that they have meanings consistent with the context of the related technique. So far as not being clearly defined in this application, terms should not be understood in an ideally or excessively formal way.

Hereinafter, exemplary embodiments of the invention will be described in detail with reference to the accompanying drawings.

Figure 2:
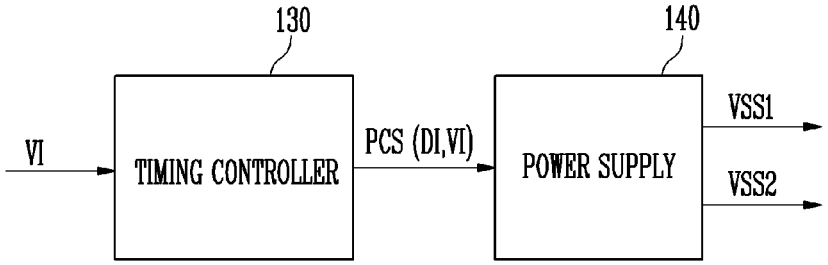
FIG. 2 is a schematic block diagram illustrating a timing controller and a power supply, which are shown in FIG. 1.

FIG. 1 is a schematic block diagram illustrating a display device according to an exemplary embodiment of the invention. FIG. 2 is a schematic block diagram illustrating a timing controller and a power supply, which are shown in FIG. 1.

Referring to FIGS. 1 and 2, the display device 10 may include a temperature sensor 110, a processor 120, a timing controller 130, a power supply 140, a scan driver 150, a data driver 160, a display unit 170, and a memory 180.

The temperature sensor 110 may generate a temperature measurement value CI by measuring an ambient temperature of the display device 10. The temperature sensor 110 may transmit the temperature measurement value CI to the processor 120.

According to an exemplary embodiment, the temperature sensor 110 may measure, in real time, the ambient temperature.

In an exemplary embodiment, the processor 120 may be implemented as an integrated circuit ("IC"), an application processor ("AP"), a mobile AP, etc., but the invention is not limited thereto.

The processor 120 may set a first scan voltage level corresponding to the ambient temperature using the temperature measurement value CI. The processor 120 may generate first scan voltage information VI, based on the set first scan voltage level. The processor 120 may transmit the first scan voltage information VI to the timing controller 130.

Here, the first scan voltage level refers to a level of a first scan voltage VSS1 generated by the power supply 140.

According to an exemplary embodiment, the processor 120 may receive a look-up table LUT supplied from the memory 180 to set a first scan voltage level corresponding to the ambient temperature.

That is, the processor 120 may select a first scan voltage level corresponding to a current ambient temperature among first scan voltage levels stored in the look-up table LUT. The processor 120 may generate first scan voltage information VI, based on the selected first scan voltage level.

According to another exemplary embodiment, the processor 120 may set the first scan voltage level using a previously set reference temperature.

When the ambient temperature is higher than or equal to the reference temperature, the processor 120 may set the first scan voltage level to be a first voltage level. When the ambient temperature is lower than the reference temperature, the processor 120 may set the first scan voltage level to be a second voltage level greater than the first voltage level.

According to still another exemplary embodiment, the processor 120 may determine a current ambient temperature changed in real time using a temperature measurement value. In this case, the processor 120 may set the first scan voltage level to be in inverse proportion to a change in ambient temperature.

In an exemplary embodiment, when the ambient temperature increases, the processor 120 may set the first scan voltage level to be lower than a current first scan voltage level, for example.

The processor 120 may transmit an image signal IM and a control signal CS to the timing controller 130. In an exemplary embodiment, the control signal CS may include a vertical synchronization signal, a horizontal synchronization signal, a data enable signal, a clock signal, and the like, for example.

The timing controller 130 may generate delta voltage information DI by determining a difference between the first scan voltage level and a second scan voltage level. Here, the second scan voltage level refers to a level of a second scan voltage VSS2 to be generated by the power supply 140.

The timing controller 130 may generate a power control signal PCS, based on the delta voltage information DI and the first scan voltage information VI, and supply the power control signal PCS to the power supply 140.

According to an exemplary embodiment, the timing controller 130 may determine, as a constant level, the difference between the first scan voltage level and the second scan voltage level, regardless of the change in ambient temperature.

The timing controller 130 may generate a scan control signal SCS using the control signal CS, and generate image data DATA using the image signal IM.

The timing controller 130 may transmit the scan control signal SCS to the scan driver 150.

The timing controller 130 may transmit the image data DATA and a data control signal DCS to the data driver 160.

The power supply 140 receives input power to generate a driving voltage required in each component of the display device 10. In an exemplary embodiment, the power supply 140 may generate a driving voltage using an input voltage, and supply the driving voltage to the scan driver 150 and the data driver 160.

Particularly, the power supply 140 generates a first scan voltage VSS1 and a second scan voltage VSS2, based on the power control signal PCS. The power supply 140 may transmit the first and second scan voltages VSS1 and VSS2 to the scan driver 150. A method in which the power supply 140 generates the first and second scan voltages VSS1 and VSS2 will be described in detail with reference to FIG. 3.

According to an exemplary embodiment, the power supply 140 may generate the second scan voltage VSS2 having a lower level than the first scan voltage VSS1.

The scan driver 150 may generate a scan signal SS using the first and second scan voltages VSS1 and VSS2. That is, the scan driver 150 may generate a scan signal SS having a first scan voltage level and a second scan voltage level.

The scan driver 150 may transmit the scan signal SS to scan lines in response to the scan control signal SCS.

The data driver 160 may generate a data signal DS using the image data DATA and the data control signal DCS, and transmit the data signal DS to data lines.

The display unit may include pixels coupled to the scan lines and the data lines to display images.

In an exemplary embodiment, the display unit 170 may be implemented as an organic light emitting display panel, a liquid crystal display panel, a plasma display panel, etc., for example, but the invention is not limited thereto.

When the first scan voltage has a higher level than the second scan voltage, each pixel may receive a scan signal SS having a high-level first scan voltage VSS1 and a low-level second scan voltage VSS2.

When a scan signal SS is supplied to a scan line, each pixel may receive a data signal DS supplied from a data line, and emit light with a luminance corresponding to the data signal DS.

According to an exemplary embodiment, each pixel may receive a data signal DS when receiving a high-level scan signal SS.

According to another exemplary embodiment, each pixel may receive a data signal DS when receiving a low-level scan signal SS.

The memory 180 may store a look-up table LUT. Here, the look-up table LUT may include first scan voltage levels corresponding to ambient temperatures. The memory 180 may transmit the look-up table LUT to the processor 120 in response to a request of the processor 120.

Figure 3:
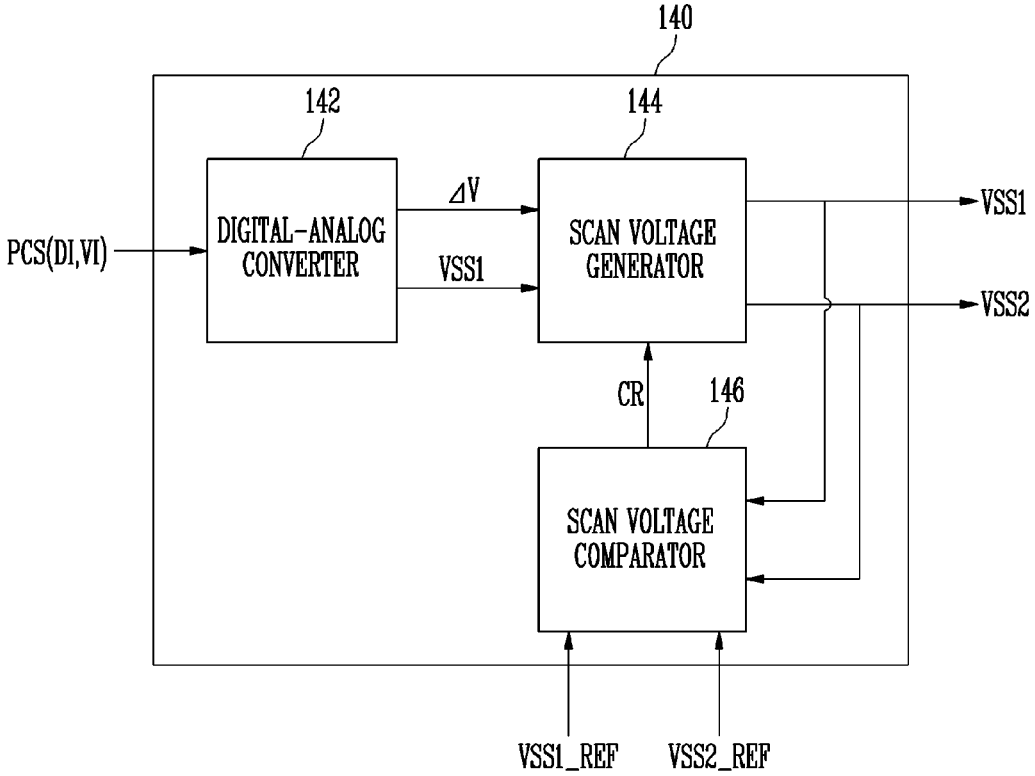
FIG. 3 is a schematic block diagram illustrating the exemplary embodiment of a method in which the power supply generates a first scan voltage and a second scan voltage according to the invention.

FIG. 3 is a schematic block diagram illustrating a method in which the power supply generates the first scan voltage and the second scan voltage according to the exemplary embodiment of the invention.

Referring to FIGS. 1 and 3, the power supply 140 may include a digital-analog converter 142, a scan voltage generator 144, and a scan voltage comparator 146.

The digital-analog converter 142 may generate an analog signal by the voltage control information PCS that is a digital signal. In an exemplary embodiment, the digital-analog converter 142 may generate a first scan voltage VSS1, based on the first scan voltage information VI included in the voltage control information PCS, and generate a delta voltage ΔV, based on the delta voltage information DI, for example.

The digital-analog converter 142 may supply the first scan voltage VSS1 and the delta voltage ΔV to the scan voltage generator 144.

The scan voltage generator 144 may generate a second scan voltage VSS2 using the first scan voltage VSS1 and the delta voltage ΔV.

In an exemplary embodiment, the scan voltage generator 144 may generate the second scan voltage VSS2 by dropping the delta voltage ΔV from the first scan voltage VSS1, for example.

As described above, the processor 120 determines the first scan voltage level depending on an ambient temperature, and hence the digital-analog converter 142 may generate a first scan voltage VSS1 having the level changed depending on the ambient temperature.

In this case, the delta voltage ΔV have a constant level regardless of the ambient temperature. Thus, when the scan voltage generator 144 drops the delta voltage ΔV from the first scan voltage, a second scan voltage VSS2 having a level changed depending on the ambient temperature is generated, like the first scan voltage VSS1.

When the scan voltage generator 144 generates the first and second scan voltages VSS1 and VSS2 corresponding to the ambient temperature as described above, the power supply 140 according to the exemplary embodiment of the invention can prevent noise from being generated in the scan signal SS. Also, the power supply 140 according to the exemplary embodiment of the invention can block leakage current generated in the scan driver 150, thereby minimizing current consumption of the scan driver 150.

The scan voltage generator 144 may supply the first scan voltage VSS1 and the second scan voltage VSS2 to the scan driver 150.

The first and second scan voltages VSS1 and VSS2 supplied to the scan driver 150 may be fed back to the scan voltage comparator 146 to compare the fed-back voltages with reference voltages, and the scan voltage comparator 146 supplies a comparison result CR to the scan voltage generator 144.

According to an exemplary embodiment, the scan voltage comparator 146 may compare the first scan voltage VSS1 with a first reference voltage VSS1_REF among the reference voltages, and compare the second scan voltage VSS2 with a second reference voltage VSS2_REF among the reference voltages.

That is, the scan voltage comparator 146 may determine whether the first scan voltage VSS1 and the second scan voltage VSS2 are respectively generated at the same levels as the reference voltages, and supply a comparison result CR to the scan voltage generator 144.

Here, the first reference voltage VSS1_REF is a first scan voltage level determined by the processor 120 depending on an ambient temperature, and the second reference voltage VSS2_REF is a second scan voltage level obtained by reflecting the delta voltage ΔV to the first scan voltage level.

According to an exemplary embodiment, the scan voltage comparator 146 may receive a second reference voltage VSS2_REF generated based on the first scan voltage information VI and the delta voltage information DI from the timing controller 130.

In an exemplary embodiment, when the first scan voltage VSS1 is −4.8V and the first reference voltage VSS1_REF is −4.5V, the first scan voltage VSS1 has an error of −0.3V as compared with a desired voltage level, for example. Therefore, the scan voltage comparator 146 may transmit, to the scan voltage generator 144, a comparison result CR including information on the error of −0.3V, for example.

In an exemplary embodiment, when the second scan voltage VSS2 is −7V and the second reference voltage VSS2_REF is −8.5V, the second scan voltage VSS2 has an error of 1.5V as compared with a desired voltage level, for example. Therefore, the scan voltage comparator 146 may transmit, to the scan voltage generator 144, a comparison result CR including information on the error of 1.5V.

The scan voltage generator 144 may generate a first scan voltage and a second scan voltage, which are respectively corrected by boosting or dropping the first scan voltage VSS1 and the second scan voltage VSS2, based on the comparison result CR.

In an exemplary embodiment, when the scan voltage generator 144 receives a comparison result CR including the information on the error of −0.3V with respect to the first scan voltage VSS1, the scan voltage generator 144 may generate a first scan voltage corrected by compensating a currently generated first scan voltage VSS1 for 0.3V, for example.

In an exemplary embodiment, when the scan voltage generator 144 receives a comparison result CR including the information on the error of 1.5V with respect to the second scan voltage VSS2, the scan voltage generator 144 may generate a second scan voltage corrected by compensating a currently generated second scan voltage VSS2 for 1.5V, for example.

In this case, the difference between the corrected first scan voltage and the corrected second scan voltage maintains the delta voltage ΔV.

As such, the power supply 140 according to the exemplary embodiment of the invention can monitor, in real time, the first scan voltage VSS1 and the second scan voltage VSS2, supplied to the scan driver 150, thereby stably generating the first scan voltage VSS1 and the second scan voltage VSS2.

In the exemplary embodiment of the invention, there is illustrated a method in which the scan voltage comparator 146 determines whether the first scan voltage VSS1 and the second scan voltage VSS2 are respectively generated at desired levels using the first reference voltage VSS1_REF and the second reference voltage VSS2_REF. However, this is merely an exemplary embodiment for convenience of illustration.

Therefore, the method of determining whether the first scan voltage VSS1 and the second scan voltage VSS2 are respectively generated at the desired levels may be variously modified.

Figures 4, 5:
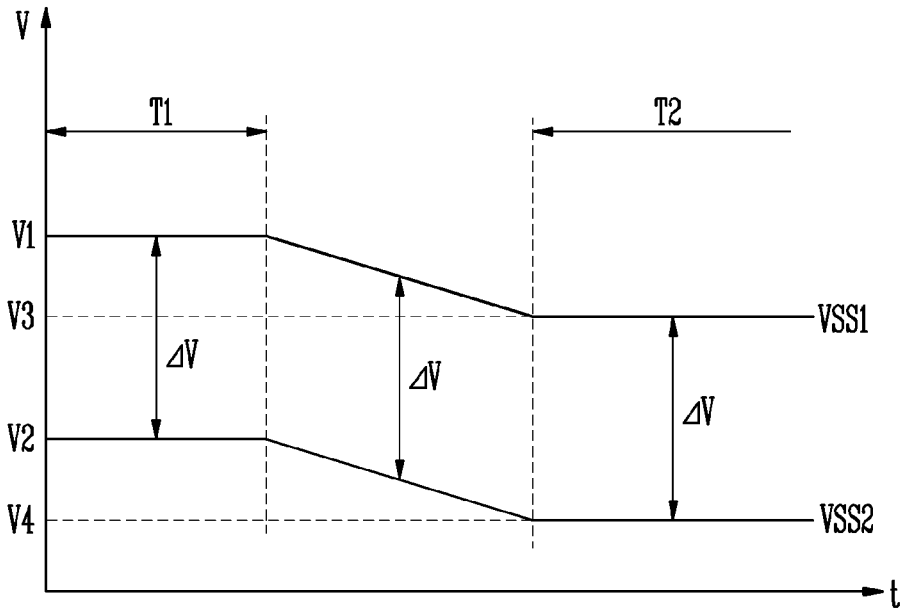
FIG. 4 is a conceptual diagram illustrating the exemplary embodiment of a look-up table according to the invention.
FIG. 5 is a waveform diagram illustrating the exemplary embodiment of the first scan voltage and the second scan voltage according to the invention.

FIG. 4 is a conceptual diagram illustrating a look-up table according to the exemplary embodiment of the invention.

The look-up table LUT shown in FIG. 4 exemplarily discloses a first scan voltage level L_VSS1, a second scan voltage level L_VSS2, and a delta voltage ΔV for helping understanding of the invention. However, the invention is not limited thereto, and may be variously modified.

Referring to FIGS. 1 and 4, the look-up table LUT according to the exemplary embodiment of the invention may include a first scan voltage level L_VSS1, a second scan voltage level L_VSS2, and a delta voltage ΔV, corresponding to an ambient temperature.

The processor 120 may set a first scan voltage level L_VSS1 corresponding to an ambient temperature T with reference to the look-up table LUT.

In an exemplary embodiment, when the ambient temperature T is lower than 20 degrees Celsius (° C.), the processor 120 may set the first scan voltage level L_VSS1 to be −4V with reference to the look-up table LUT, for example.

In an exemplary embodiment, when the ambient temperature T is higher than or equal to 20° C. and lower than 40° C., the processor 120 may set the first scan voltage level L_VSS1 to be −5V with reference to the look-up table LUT, for example.

In an exemplary embodiment, when the ambient temperature T is higher than or equal to 40° C., the processor 120 may set the first scan voltage level L_VSS1 to be −6V with reference to the look-up table LUT, for example.

According to an exemplary embodiment, the processor 120 may generate information on the first reference voltage VSS1_REF and the second reference voltage VSS2_REF using the first scan voltage level L_VSS1, the second scan voltage level L_VSS2, and the delta voltage ΔV, which are included in the look-up table LUT.

FIG. 5 is a waveform diagram illustrating the first scan voltage and the second scan voltage according to the exemplary embodiment of the invention.

Referring to FIGS. 1, 3, and 5, the power supply 140 may generate a first scan voltage VSS1 and a second scan voltage VSS2, which have the difference of a delta voltage ΔV.

The power supply 140 according to the exemplary embodiment of the invention generates a first scan voltage VSS1 having a first voltage level V1 and a second scan voltage VSS2 having a second voltage level V2 during a first period T1.

Here, the ambient temperature of the processor 120 has a higher value during a second period T2 than during the first period T1.

The ambient temperature during the first period T1 is lower than that during the second period T2.

The power supply 140 generates a first scan voltage VSS1 and a delta voltage ΔV using a power control signal PCS supplied from the timing controller 130. As described above, the power supply 140 generates a second scan voltage VSS2 by dropping the delta voltage ΔV from the first scan voltage VSS1.

When the power supply 140 receives a power control signal PCS including a newly set first scan voltage level during the second period T2, the power supply 140 generates a first scan voltage VSS1 at the newly set first scan voltage level.

In an exemplary embodiment, when the power control signal PCS includes first scan voltage information VI having a third voltage level V3, the power supply 140 generates a first scan voltage VSS1 having the third voltage level V3, for example. After that, the power supply 140 generates a second scan voltage VSS2 having a fourth voltage level V4 by dropping the delta voltage ΔV from the third voltage level V3.

Thus, the first scan voltage VSS1 and the second scan voltage VSS2 maintain the difference of the delta voltage ΔV during the second period T2.

As such, although the first scan voltage level is changed depending on a change in ambient temperature, the second scan voltage level can maintain the difference of the delta voltage ΔV with the first scan voltage level.

Thus, when the scan voltage generator 144 generates first and second scan voltages VSS1 and VSS2 corresponding to the ambient temperature, the power supply 140 according to the exemplary embodiment of the invention can prevent noise from being generated in scan signals, and block leakage current generated in the scan driver 150, thereby minimizing current consumption of the scan driver 150.

Figure 6:
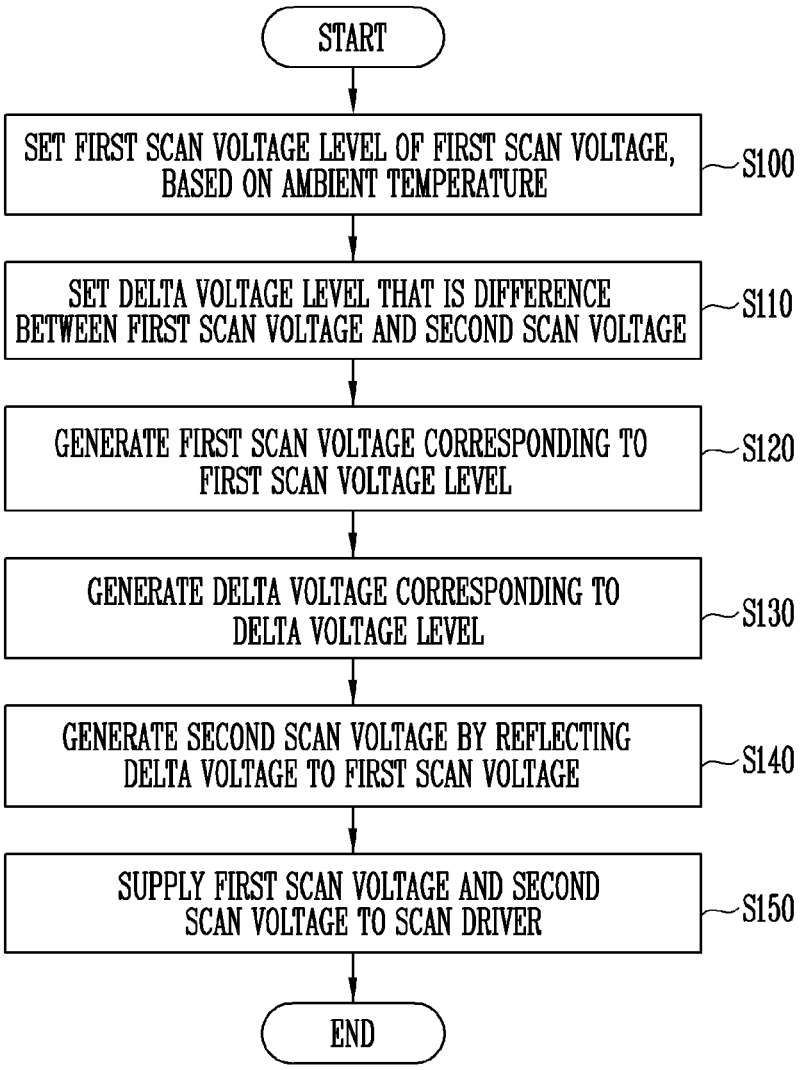
FIG. 6 is a flowchart illustrating the exemplary embodiment of an operating method of the display device according to the invention.

FIG. 6 is a flowchart illustrating an operating method of the display device according to the exemplary embodiment of the invention.

Referring to FIGS. 1 and 6, the processor 120 may set a first scan voltage level, based on an ambient temperature (S100).

The timing controller 130 may set a delta voltage level by determining a difference between a first scan voltage VSS1 and a second scan voltage VSS2 (S110). Here, the delta voltage level is a level of a delta voltage included in delta voltage information shown in FIG. 1.

The power supply 140 may generate a first scan voltage VSS1 corresponding to the first scan voltage level (S120).

The power supply 140 may generate a delta voltage corresponding to the delta voltage level (S130).

The power supply 140 may generate a second scan voltage VSS2 by reflecting the delta voltage to the first scan voltage VSS1 (S140).

The power supply 140 may supply the first scan voltage VSS1 and the second scan voltage VSS2 to the scan driver 150 (S150).

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other exemplary embodiments unless otherwise specifically indicated. Accordingly, it will be understood by those of skill in the art that various changes in form and details may be made without departing from the spirit and scope of the invention as set forth in the following claims.

What is claimed is:

1. A display device comprising:

a display unit including pixels coupled to scan lines and data lines;

a data driver which supplies a data signal to pixels through the data lines;

a scan driver which generates a scan signal using a first scan voltage and a second scan voltage, and supply the scan signal to the pixels through the scan lines;

a processor which generates first scan voltage information by setting a first scan voltage level, based on an ambient temperature of the display device;

a timing controller which generates a power control signal including the first scan voltage information and delta voltage information; and a power supply which includes:

a digital-analog converter which generates the first scan voltage, based on the first scan voltage information, generates a delta voltage, based on the delta voltage information, and directly outputs the first scan voltage and the delta voltage, wherein the delta voltage determines a difference between the first scan voltage and the second scan voltage, and the power supply generates the first scan voltage and the delta voltage using the power control signal, and generates the second scan voltage by dropping the delta voltage from the first scan voltage.

2. The display device of claim 1, wherein the processor sets the first scan voltage level to be a first voltage level when the ambient temperature is higher than or equal to a reference temperature, and sets the first scan voltage level to be a second voltage level when the ambient temperature is lower than the reference temperature.

3. The display device of claim 2, wherein the first voltage level is lower than the second voltage level.

4. The display device of claim 1, wherein the processor sets the first scan voltage level to be in inverse proportion to a change in the ambient temperature.

5. The display device of claim 1, wherein the timing controller generates the delta voltage information by setting the delta voltage to be a constant level regardless of the ambient temperature.

6. The display device of claim 1, wherein the timing controller generates the delta voltage information by determining a level difference between the first scan voltage and the second scan voltage.

7. The display device of claim 1, wherein the power supply further includes:

a scan voltage generator which generates the second scan voltage by dropping the delta voltage from the first scan voltage, and supplies the first scan voltage and the second scan voltage to the scan driver.

8. The display device of claim 7, wherein the power supply further includes a scan voltage comparator to which the first scan voltage and the second scan voltage supplied to the scan driver are fed back, which compares the fed-back first and second scan voltages with reference voltages, respectively, and which supplies a comparison result to the scan voltage generator.

9. The display device of claim 8, wherein the scan voltage generator generates a first scan voltage and a second scan voltage, which are respectively corrected by boosting or dropping the first and second scan voltages, based on the comparison result.

10. The display device of claim 9, wherein the corrected first scan voltage and the corrected second scan voltage have the difference of the delta voltage.

11. The display device of claim 1, wherein the scan driver generates the scan signal having the first scan voltage level and a second scan voltage level.

12. The display device of claim 11, wherein when the supplied scan signal has the first scan voltage level, each of the pixels is supplied with the data signal.

13. The display device of claim 1, further comprising a memory which stores a look-up table including the first scan voltage level corresponding to the ambient temperature.

14. A method of operating a display device including a scan driver for generating a scan signal using a first scan voltage and a second scan voltage, the method comprising:

setting, by a processor, a first scan voltage level of the first scan voltage, based on an ambient temperature of the display device;

setting, by a timing controller, a delta voltage level by determining a difference between the first scan voltage and the second scan voltage;

generating and directly outputting, by a digital-analog converter of a power supply, the first scan voltage corresponding to the first scan voltage level;

generating and directly outputting, by the digital-analog converter of the power supply, a delta voltage corresponding to the delta voltage level;

generating, by the power supply, the second scan voltage by dropping the delta voltage to the first scan voltage; and supplying, by the power supply, the first scan voltage and the second scan voltage to the scan driver.

15. The method of claim 14, wherein, in the setting the first scan voltage level, the first scan voltage level is set to be a first voltage level when the ambient temperature is higher than or equal to a reference temperature, and the first scan voltage level is set to be a second voltage level when the ambient temperature is lower than the reference temperature.

16. The method of claim 14, wherein, in the generating the second scan voltage, the second scan voltage is generated by dropping the delta voltage level from the first scan voltage level.

17. The method of claim 14, further comprising:

feeding back the first scan voltage and the second scan voltage, which are supplied to the scan driver, to the power supply;

comparing, by the power supply, the fed-back first and second scan voltages with reference voltages; and adjusting, by the power supply, the first scan voltage and the second scan voltage using a comparison result.

* * * * *